United States Patent [19]

Canno

[11] 4,018,142

[45] Apr. 19, 1977

[54] BOX-BAG WITH PERMANENTLY SECURED HANDLE

[75] Inventor: Leonard E. Canno, New York, N.Y.

[73] Assignee: Equitable Bag Co., Inc., Long Island City, N.Y.

[22] Filed: Apr. 19, 1976

[21] Appl. No.: 677,896

[52] U.S. Cl. ..... 93/35 H; 93/8 W; 93/33 R; 229/54 R

[51] Int. Cl.[2] ..... B31B 1/86; B31B 49/04

[58] Field of Search ..... 93/35 H, 8 WA, 8 W, 93/33 R, 36.01, 56 PD, 58 R, 58 P; 156/510; 229/54 R

[56] References Cited

UNITED STATES PATENTS

| | | | |
|---|---|---|---|
| 3,040,633 | 6/1962 | Davis | 93/35 H |
| 3,194,125 | 7/1965 | Davis | 93/35 H |
| 3,439,591 | 4/1969 | Class | 93/33 UX |
| 3,611,883 | 10/1971 | Grob | 93/8 W X |

*Primary Examiner*—Roy Lake
*Assistant Examiner*—E. F. Desmond
*Attorney, Agent, or Firm*—Roy C. Hopgood; John M. Calimafde; Eugene J. Kalil

[57] ABSTRACT

This specification describes an improved method for making a container that has a square bag construction at its lower end and an upper end constructed as a folding box. The method produces such a container with a flexible handle that is permanently attached to the container in contrast with the prior art where economical construction requires that the user attach a separate handle to the container. With this invention, changes in the reinforcing of the upper panels of the container and a novel sequence in the manufacturing steps make the provision of a permanently attached handle both economical and practical. The product has novel features of construction that make it possible to manufacture the product on automatic machines which make conventional shopping bags and with limited alterations in the standard shopping bag machines.

11 Claims, 5 Drawing Figures

BOX-BAG WITH PERMANENTLY SECURED HANDLE

PRIOR ART

Patents of interest in relation to making shopping bags include Davis U.S. Pat. Nos. 3,040,633 and 3,194,125, issued June 26, 1962 and July 13, 1965, respectively. A container having a bag bottom construction similar to a shopping bag and a folding box construction at its upper end is disclosed in the Canno U.S. Pat. No. 3,447,736, issued June 3, 1969.

BACKGROUND AND SUMMARY OF THE INVENTION

Containers having their lower ends formed with a square bottom bag construction and their upper ends formed with a folding box construction are popular with purchasers, espcially purchasers of wearing apparel. Such containers have the advantages of a folding box combined with the convenience of a shopping bag which can be conveniently carried by handles at the end of the bag. Since the containers in which the goods are placed when sold to a customer adds to the overhead of the store, it is essential that the containers be capable of economical manufacture in order to be acceptable to merchandisers.

Conventional shopping bags are very widely used, and machinery has been developed for the automatic manufacture of shopping bags in large volume and at low cost.

This invention is believed to be the first construction and method which makes possible the manufacture on shopping bag type machines of containers having a bag construction at the lower end and a folding box construction at the upper end.

One of the disadvantages of the prior art has been that machines used for making the containers of the type to which this invention relates had no provision for attaching handles to the containers in such a way that the handle was a permanent part of the container. Either the handle had to be assembled with the bag after the bag was filled and during the closing of the bag, or handles had to be attached to the finished bags by a separate or additional operation, and usually a hand operation greatly increasing the cost of the containers.

By some changes in the design of the container and by a novel sequence in the manufacturing steps, this invention provides a better product with a permanently connected handle, greater strength and at greater economy in manufacture.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
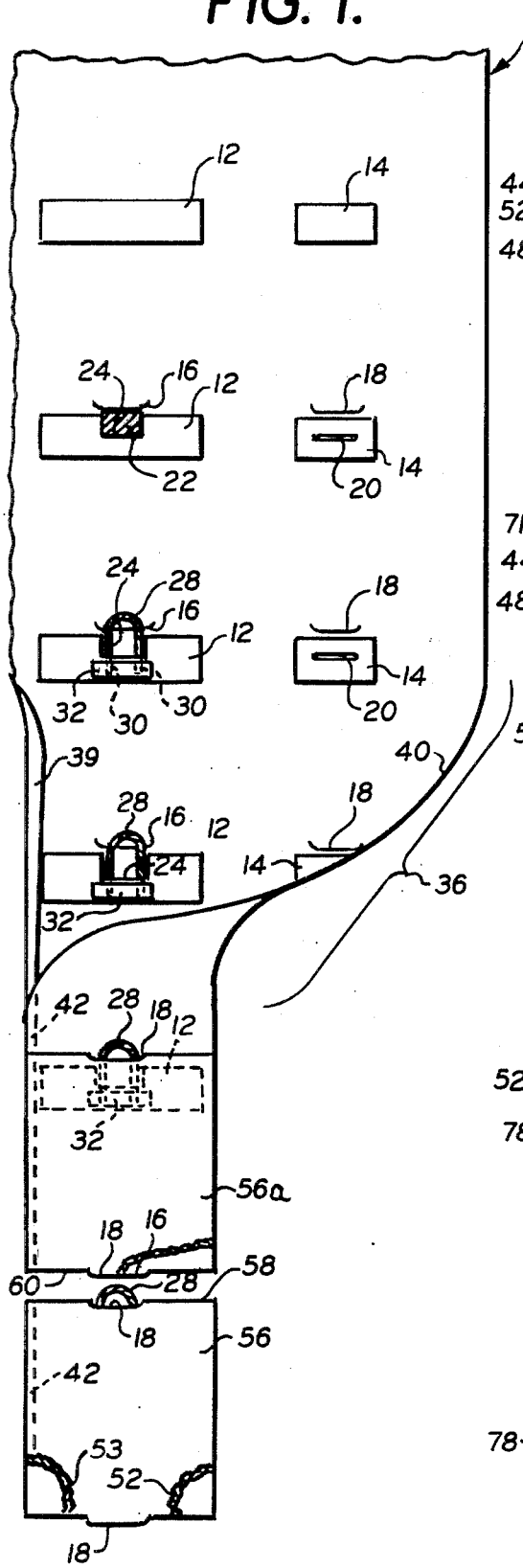
FIG. 1 is a diagrammatic view illustrating the different steps in the manufacture of the container of this invention.

A web 10 of flat sheet material is advanced in the direction of its length. This web is preferably a paper web; but other flexible materials can be used. Paper has the advantage of considerable strength and low cost. A reinforcing strip 12 is applied to the web by adhesive and at a location which will constitute a front top panel of the container. This reinforcing sheet 12 preferably extends for substantially the full width of the container.

Another reinforcing strip 14 is applied by adhesive to the web 10 at a location which will constitute the rear top panel of the container; and this reinforcing strip 14 is substantially shorter than the reinforcing sheet 12. Both of the sheets 12 and 14 are preferably cardboard; but other stiffening material can be used. The cardboard is preferably substantially stiffer than the web 10.

The next operation illustrated in FIG. 1 is a cutting operation, in which the web is cut along two transversely extending lines 16 and 18 with the edges of the cuts curved upwardly to a slight extent so that exact register of the cuts 16 and 18 with the final cuts is not necessary.

In addition to the transversely extending cuts 16 and 18, a narrow slit 20 is cut through the reinforcing sheet 14 at a location spaced from all of the edges of the sheets 14. On another station, a punch 22 cuts through the sheet 12 and web 10 over the area indicated by the cross-hatching of the punch 22. The amount of material removed by the punch 22 extends from the transverse cut 16 to a location below the top edge of the sheet 12, so as to leave a notch 24 in the sheet 12.

The notch 24 has a depth which is preferably about one-half the width of the front top panel of the container which is to be formed from the web 10. The width of the notch 24 should be slightly greater than the width of the handle which is to be applied to the container. The notch can be substantially wider than this, but if it is unnecessarily wide, the stiffness of the front top panel is reduced.

At the next station, there is no operation performed on the reinforcing sheet 14; but a handle 28 is applied to the reinforcing sheet 12 just below the notch 24. The handle 28 is a flexible bail, which may be made of cord, plastic or other elongated flexible material. The handle 28 has ends 30 which overlap the sheet 12 below the notch 24. These ends 30 are connected with the surface of the sheet 12 by adhesive or other fastening means. In the preferred construction, a strip 32 is adhesively applied over the ends 30 of the handle 28, and the connection of this strip 32 to the handle ends 30 and to the reinforcing sheet 12 greatly increases the strength of the connection of the handle to the web 10.

The width of the handle 28—that is, the distance between the ends 30—is enough to to permit a person to place his hand through the bail formed by the handle 28. The handle 28 extends far enough above the bottom of the notch 24 to permit a person to conveniently and comfortably place their fingers through the space within the handle.

The web 10 is then folded a long a length indicated by the brace and reference character 36. The left hand edge portion of the web 10 is folded over to form a flap 39 which is secured to the right hand edge portion 40 of the web so as to form a seam 42, best shown in FIG. 2, and this seam is sealed, preferably by adhesive.

Figure 2:
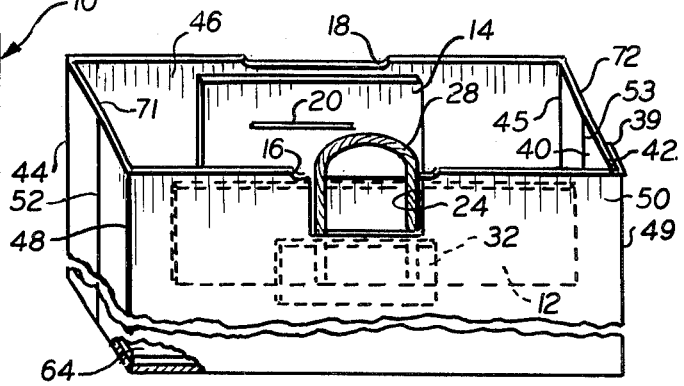
FIG. 2 is an isometric view of the uper end of the container made in accordance with this invention, and showing the container open for receiving merchandise.

The web is folded along lines 44 and 45 which comprise the ends of a rear top panel 46, best shown in FIG. 2.

The distance between the fold lines 44 and 48 on the left side of the container, and between the folds 45 and 49 on the right side of the container, determine the size of the container from front to rear when in open position. These distances, of course, are usually the same. In order to have the container fold flat for shipping and when not in use, the sides of the container are folded inwardly along lines 52 and 53, at opposite sides of the container, and this is analogous to the folding of a conventional shopping bag.

After the web has been folded along the lines described, the series of connected container blanks formed by the folded web are cut apart by successively severing the end container bland 56 (FIG. 1) from the next successive container bland 56a along a line of cut 58 which extends across all portions of the web, except those portions previously cut by the transverse cuts 16 and 18. A lower end 60 is folded, as in the case of shopping bags, to make a square bottom bag construction for the successive containers. A folded bottom for the container 56 is indicated in FIG. 1 by the reference character 64. Since such bottoms are well known in the art, no showing of the bottom of the container appears in the subsequent figures of the drawing.

In FIG. 2, the left and right top side panels are indicated by the reference characters 71 and 72, respectively. These top panels 71 and 72 are shown extending upright, as are the rear and front panels 46 and 50, respectively. The container is closed by folding these panels over one another, preferably in the sequence indicated in FIGS. 3–5.

Figure 3:
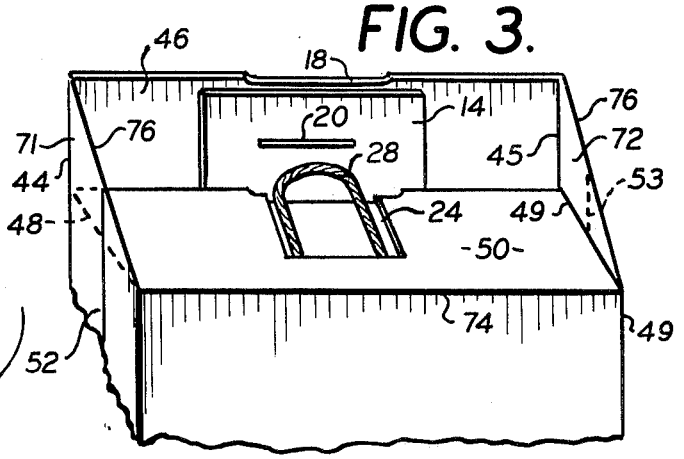
FIG. 3 is a view similar to FIG. 2 but showing the front panel folded down as the first step in closing the bag.

FIG. 3 shows the front top panel 50 folded rearwardly along a fold line 74, which is adjacent to the lower edge of the reinforcing sheet 12.In order to fold the front top panel 50 down into a horizontal position, as shown in FIG. 3, it is necessary to fold each of the side top panels 71 and 72 along the diagonal lines indicated by the reference character 76.

Figure 4:
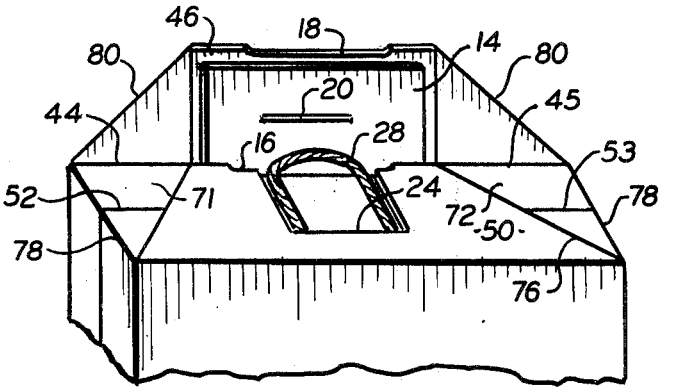
FIG. 4 shows the folding down of the top side panels as the next step in closing the bag.

Each side top panel 71 and 72 is then folded toward the other and downward into contact with the top surface of the front top panel 50, as shown in FIG. 4. These folds are made along lines 78, which are in substantially the same plane as the folded-down panel 50. In order to effect this folding-down of the panels 71 and 72, it is necessary to fold down end portions of the rear top panel along lines 80, shown in FIG. 4.

Figure 5:
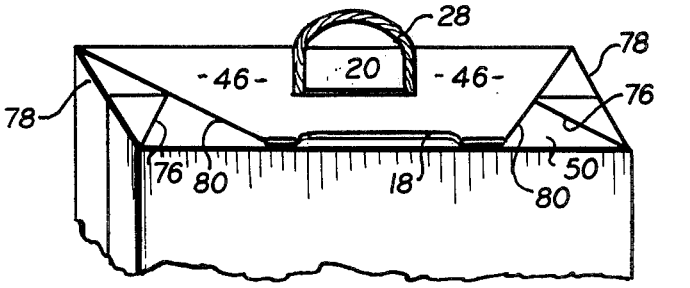
FIG. 5 shows the rear top panel folded down to fully close the bag and shows the handle pulled through a slot in the back top panel to hold the container closed.

The next and final step in closing the container is to insert the handle 28 through the slot 20, which is narrower than the diameter of the cord from which the handle 28 is made. This causes the sides of the slot 20 to grip the handle 28 with substantial friction, so that when the rear top panel 46 is folded down into contact with the other folded panels, as shown in FIG. 5, the friction of the sides of the slot 20 against the handle 28 hold the container closed.

The preferred embodiment of the invention has been illustrated and described, but changes and modifications can be made and some features can be used in different combinations without departing from the invention as defined in the claims.

What is claimed is:

1. The method of making a container with a bag-like lower end portion and a top portion that is constructed with features of a folding box, including advancing a web in the direction of its length, making successive transverse cuts through the web at locations that correspond to a mid-region of the top of successive container blanks that are made from the web, securing reinforcing sheets to the web over areas that will form the top portion at the front and rear of each container blank, cutting away at least a part of the front top panelarea for a distance extending down from the upper end of the container blank and of a width greater than the width of a handle that is to be applied to the upper part of the front of the container, forming a slot through the reinforcing sheet of the rearward top area in a direction transverse of the length of the web and at a distance below the top of the container blank approximately equal to the depth of the cut-away part of the front top panel area, applying a handle to the front top panel area with the handle permanently connected to said front top panel area at a location below the level of the cut-away part, folding the web lengthwise to form container blanks, and severing successive blanks from the folded web at the top end of the rear top panel area.

2. The method described in claim 1 characterized by cutting away only a transversely extending center region of the front top panel area to form a notch therein wider than a person's hand, securing a cord handle to the inside of the front top panel with a bail of the cord extending upward from the bottom of the notch for a distance large enough for a person using the container to insert his fingers through the loop of the bail, the ends of the cord being spaced from one another by a distance approximately equal to the width of the notch with the ends of the cord secured to the reinforcing sheet of the front top panel area below the bottom of the notch.

3. The method described in claim 1 characterized by the reinforcing sheet for the front top panel area being secured to the inside of the front top panel area, and the handle being secured to the inside surface of the reinforcing sheet.

4. The method described in claim 3 characterized by the reinforcing sheet being secured to the inside surface of the front top panel area by adhesive, and the handle being secured to the reinforcing sheet by adhesive and by an inside strip of material that is applied over the ends of the handle and that extends across the inside surface of the reinforcing strip in the region of the handle and secured by adhesive to the reinforcing strip at said region.

5. The method described in claim 1 characterized by severing successive containers from one another by cutting through the folded web at the upper ends of the front and rear top panel areas at those regions of the width of the web where the web has not already been cut by said successive transverse cuts.

6. The method described in claim 5 characterized by making successive transverse cuts at similar locations of the front and back top panel areas, and making the handle extend beyond the upper limits of both the front and rear top panel areas and across said transverse cuts when the web is folded and ready for severing successive containers from the folded web.

7. The method described in claim 1 characterized by folding the web to provide sides of the container that extend from the front panel area to the back panel area of each container blank, folding and securing the front, rear and side areas at the end of the web to form a square bottom bag construction, cutting each successive container blank from the folded web at the top of the reinforced front and rear top panel areas to leave the upper end of each container blank with top panel areas that can fold to form a box-like upper end for each container, and holding the box-like areas at the upper end of the conainer in folded condition, when the container is closed, by pulling the handle through the slot in the reinforcing sheet of the rear top panel.

8. The method described in claim 1 characterized by folding the web to provide sides of the container that extend from the front panel area to the rear panel area of each container blank, the depth of the cut-away part of the reinforcing sheet of the top front panel being of a depth substantially less than the front-to-rear width of the sides of the container.

9. The method described in claim 8 characterized by the reinforcing sheets of the front and rear top panel areas extending downward from a top edge of the container blank for a distance substantially equal to the width of the sides of the container and forming top panels that fold down to form, with the upper parts of the sidewalls, the box-like upper end of the container, and closing the container by folding down the front top panel first, then the top areas of the sides of the container, and then the rear top panel to cover over the cut-away part of the front top panel.

10. The method described in claim 1 characterized by making the reinforcing sheet at the top of the front panel substantially as wide as the front panel, and making the reinforcing sheet for the top of the rear panel substantially less than that of the width of the front and rear panels of the container.

11. The method described in claim 1 characterized by using a paper web and cardboard sheets for reinforcing the upper ends of the web of each container blank.

* * * * *